United States Patent [19]

Schettl et al.

[11] 4,084,572

[45] Apr. 18, 1978

[54] SELF-CLEANING OVEN SHUTTER DOOR

[75] Inventors: Alvin J. Schettl; Charles R. Gorski, both of Grand Rapids, Mich.

[73] Assignee: Kelvinator, Inc., Grand Rapids, Mich.

[21] Appl. No.: 736,552

[22] Filed: Oct. 28, 1976

[51] Int. Cl.[2] ..... F24C 15/04

[52] U.S. Cl. ..... 126/200; 126/198

[58] Field of Search ..... 126/198, 200

[56] References Cited

U.S. PATENT DOCUMENTS

| | | | |
|---|---|---|---|
| 3,311,106 | 3/1967 | Baughman et al. | 126/200 |
| 3,396,717 | 8/1968 | Winkler et al. | 126/200 |
| 3,717,138 | 2/1973 | Upp | 126/200 |
| 3,760,792 | 9/1973 | White | 126/200 |

*Primary Examiner*—John J. Camby
*Assistant Examiner*—Larry I. Schwartz
*Attorney, Agent, or Firm*—McNenny, Pearne, Gordon, Gail, Dickinson & Schiller

[57] ABSTRACT

An oven door assembly for hinge mounting on an oven frame, the door having a glass-sealed window aperture and a shutter manually positionable between an open position permitting view of the oven contents through the window and a closed position preventing thermal radiation from the oven through the window and view of the oven contents. Shutter position indicator means governed by the movement of the shutter to and from its closed position cooperates with sensor means on the oven frame to provide an interlock for the oven heating system such that the heating system is prevented from operating when either the shutter or door is not fully closed. The shutter is disposed within an air wash zone formed by spaced door panels in a manner which permits both sides of the shutter to be cooled by convective air flow to thereby minimize heat transfer to the outer panel of the door.

2 Claims, 4 Drawing Figures

SELF-CLEANING OVEN SHUTTER DOOR

BACKGROUND OF THE INVENTION

The invention relates to improvements in self-cleaning ovens and, in particular, to means for interlocking the control of a heating device for pyrolytic cleaning to an oven window shutter position.

PRIOR ART

Cooking ovens are often provided with a window, usually in a door, to afford a view of the state of the food being cooked without requiring the door to be opened and heat to be lost to the environment. Employment of the pyrolytic cleaning process in windowed ovens has necessitated the use of a shutter to prevent the escape of excessive radiant energy from the oven cavity and to prevent casual visual observation of the unsightly characteristics of the pyrolytic process.

U.S. Pats. 3,311,106 and 3,362,396, for example, each disclose a window shutter, as well as means for latching the door in a closed position during the pyrolytic cleaning cycle. Latching arrangements such as disclosed in the former patent have the disadvantage of being incapable of distinguishing between an open door condition and a closed shutter condition, so that under certain circumstances, there is a risk that a false signal caused by an open door may allow initiation of a cleaning cycle.

SUMMARY OF THE INVENTION

The invention provides a single sensing element simultaneously sensing the closed position of an oven door and the closed position of a door window shutter to thereby enable these elements to be interlocked with controls of suitable door latching and oven heating devices provided for pyrolytic cleaning. Since the sensing means of the invention is properly conditioned only when both the door and shutter are in their respective closed positions, the potential for developing or responding to false signals is minimized.

As disclosed, the sensor element is arranged on the oven frame such that with the door closed, it protrudes through an aperture provided in a panel of the door at a point remote from the door hinge. An indicator within the door and responsive to the position of the shutter is movable along a path immediately adjacent the sensor aperture. The indicator, directly responsive to the movement of the shutter, is in confronting relation with the sensor aperture when the shutter is fully closed and, alternatively, is displaced from the aperture when the shutter is not fully closed. The indicator element is thereby enabled to physically displace the sensor element immediately upon closure of the door, allowing the sensor to initiate or otherwise enable door latching and cleaning operation. Since the indicator element is remote from the sensor aperture when the shutter is not fully closed, the sensor is not conditioned by the indicator and cleaning operations cannot be initiated when the shutter is not closed. The sensor, carried on the frame at a point remote from the door hinge, is likewise not conditioned by the indicator when the door is not fully closed regardless of the position of the shutter, so that, similarly, under an open door condition cleaning operations cannot be initiated.

Further objects and advantages of the invention will become more apparent from the following description of but one detailed embodiment of the invention.

DESCRIPTION OF THE PREFERRED EMBODIMENT

Figure 1:
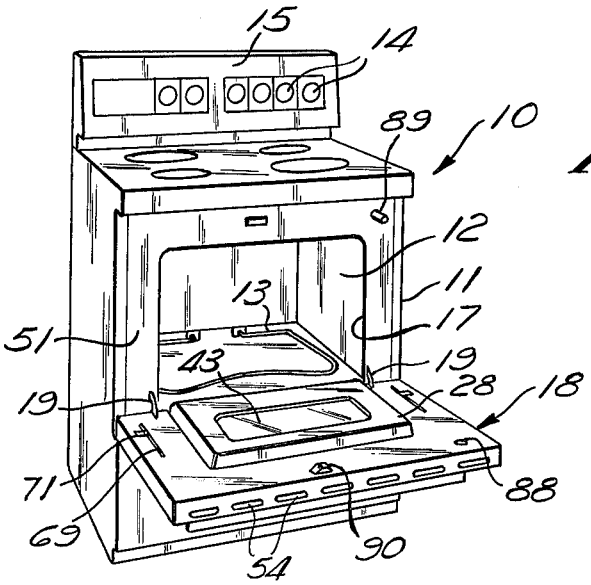
FIG. 1 is a perspective view of a free-standing range having a windowed oven door and adapted to embody the principles of the invention.

A free-standing range generally indicated at 10 includes a frame 11 formed of sheet steel in accordance with current conventional practices. An oven cavity 12 is formed within thermally insulated walls of the frame 11. The cavity 12 is heated by means of one or more electrical resistance heating elements 13. Natural gas or other controllable energy sources may, alternatively, be used to heat the cavity as desired.

Operation of the oven heating elements 13 is conventionally controlled by knobs 14 or other manually set elements at a rear control panel 15. An opening 17 in the frame 11 providing access to the cavity 12 is closed by a door 18 horizontally pivoted at its lower edge on hinges 19 of known construction, which preferably counterbalance the door weight and tend to hold the door against the frame surfaces surrounding the opening 17 when the door is in a vertical closed position. Unless otherwise noted, it will be understood that the description of the door and its various components and reference to their orientation are made with the assumption that the door is in its normal, vertically upright, closed condition.

Figure 3:
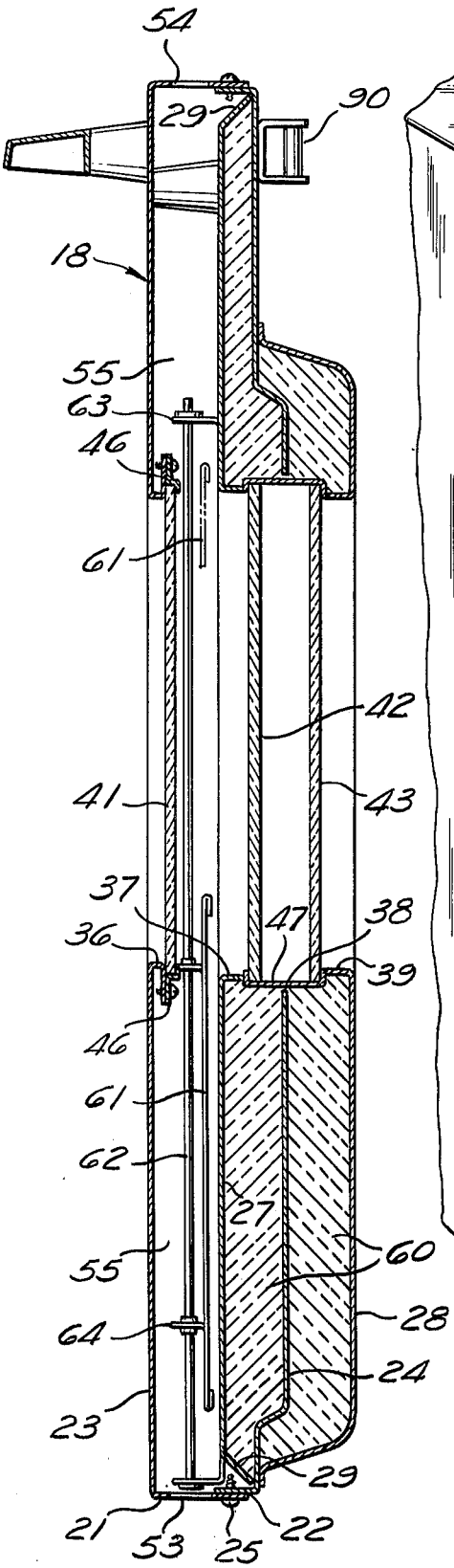
FIG. 3 is a vertical, cross sectional view of the door, taken in a plane perpendicular to that of the door.

With particular reference to FIG. 3, the door comprises a plurality of sheet steel panels each of generally rectangular configuration. Peripheral flanges 21 and 22 of an outer panel 23 and an inner liner 24 are fastened together in overlying relation by screws 25. Assembled on the inner liner before it is joined to the outer panel 23 is an interior air wash wall or sheet 27 and an exterior pan-shaped baffle panel 28. The air wash sheet 27 and baffle panel 28 are secured to the liner 24 by suitable means, such as screws and suitable standoff brackets (not shown) extending between these elements. The air wash sheet 27 is formed with obtuse flanges 29 extending along its upper and lower edges and right angle flanges 31 (FIG. 4) on its vertical edges.

Taken in order from the exterior to the interior side of the door, the outer panel 23, the air wash sheet 27, the inner liner 24, and the baffle 28 are preferably formed of steel sheet, with the first and last enumerated elements 23 and 28, at least, being coated with porcelain or other suitable appearance coating on their exterior or visible sides. Each of these sheets and panels extends for the most part in planes parallel to one another and the plane of the door assembly 18. Further, the sheet and panel elements 23, 27, 24, and 28 are provided with substantially aligned, rectangular openings 36–39, respectively, of a generally common size. These apertures provide a window or light through the door assembly 18. Glass panels 41, 42, and 43 are disposed at the door apertures to isolate the gaseous environment within the oven cavity 12 when the door is in its closed position. An outermost glass 41 is retained against the aperture 36 of the outer panel 23 by a suitable perimeter frame 46 screwed or otherwise secured to the outer panel. Inner spaced glass elements 42 and 43 are carried by a common perimeter frame 47 of U-shaped cross section and provide a hermetically sealed space therebetween. Mounting tabs, welded or otherwise fixed on the outer periphery of the frame 47, enable the frame and glass panels 42 and 43 to be screwed or otherwise fastened on the inner liner 24.

Commercially available moldings and gaskets (not shown) may be used to seal and improve the appearance of the lines of contact of the glass elements 41, 42, and 43, and the visible door panels 23 and 28. Further, a commercial gasket (not shown) suitable for high-temperature service may be provided along the base of the baffle plate 28 where it is joined to the liner 24 to permit the door assembly 18 to adequately seal against a frontal face 51 (FIG. 1) of the frame surrounding the oven opening 17 to thereby contain gases within the cavity 12.

Portions of the peripheral flanges 21 of the outer panel 23 are apertured, as at 53 and 54 in FIG. 3, across the full width of the door assembly 18 to provide a flow path for natural vertical convection of air through an air wash space 55 between the outer panel 23 and air wash sheet 27 when the door is closed. This natural air convection cools the outer panel to thereby prevent it from reaching excessive temperatures during cooking or cleaning operations in the oven cavity 12. Fiberglass or mineral wool insulation 60 is disposed between various panels of the door to reduce heat transfer from the oven cavity. A heat insulating pad (not shown) of asbestos or similar material may be provided on the interior side of the outer panel 23 to minimize transfer of heat to it.

A movable, rectangular shutter 61 is disposed in the air wash space 55 on a pair of vertical steel guide rods 62. The guide rods 62 are mounted at their ends on tabs 63 stamped from the air wash sheet 27 such that the rods extend in parallel relation to the air wash sheet, and therefore the plane of the door assembly 18. The shutter 61, formed of aluminum sheet stock or other material suitable for moderate temperature service, is provided with four similar tabs 64 for cooperation with the guide rods 62. Guide bushings 66 allow smooth sliding movement of the shutter 61 on the rods 62. As illustrated most clearly in FIG. 2, the shutter 61 is a generally rectangular, planar body having an imperforate area somewhat larger than that of the panel apertures 36 through 39, so that it is capable of substantially fully obstructing radiation passing through the inner glass sheets 42 and 43.

Figure 4:
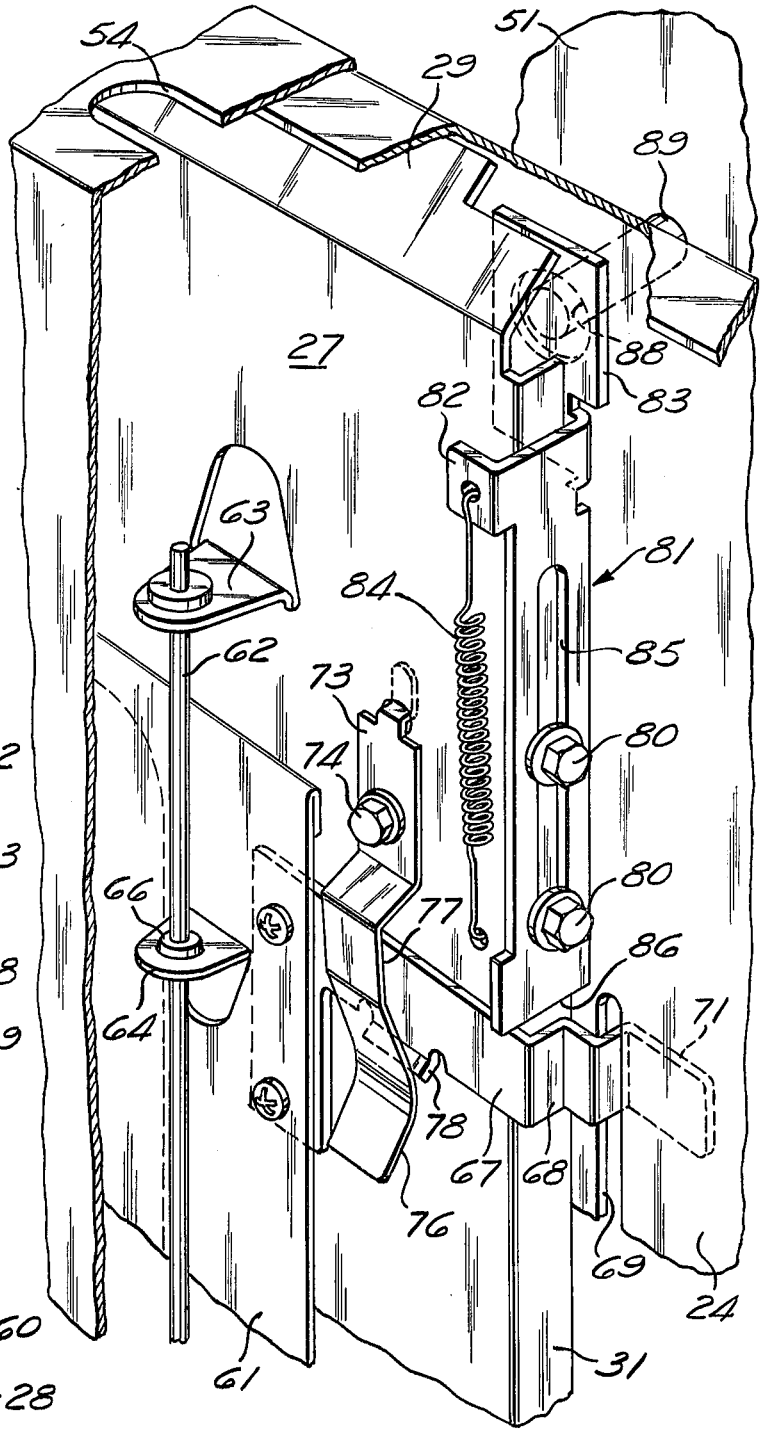
FIG. 4 is a perspective view of an internal portion of the door assembly corresponding to the upper right-hand area of FIG. 2 and illustrating details of a shutter position indicator.

A pair of handle brackets 67 fastened to the shutter 61 by screws or other suitable means extend laterally from the shutter and include a stepped portion 68 which turns inwardly adjacent the associated air wash sheet flanges 31. As seen in FIG. 4, the stepped handle portion 68 extends through an elongated slot formed in the inner liner 24 and terminates at a hand grip portion 71 lying in a plane generally parallel to the plane of the door.

Figure 2:
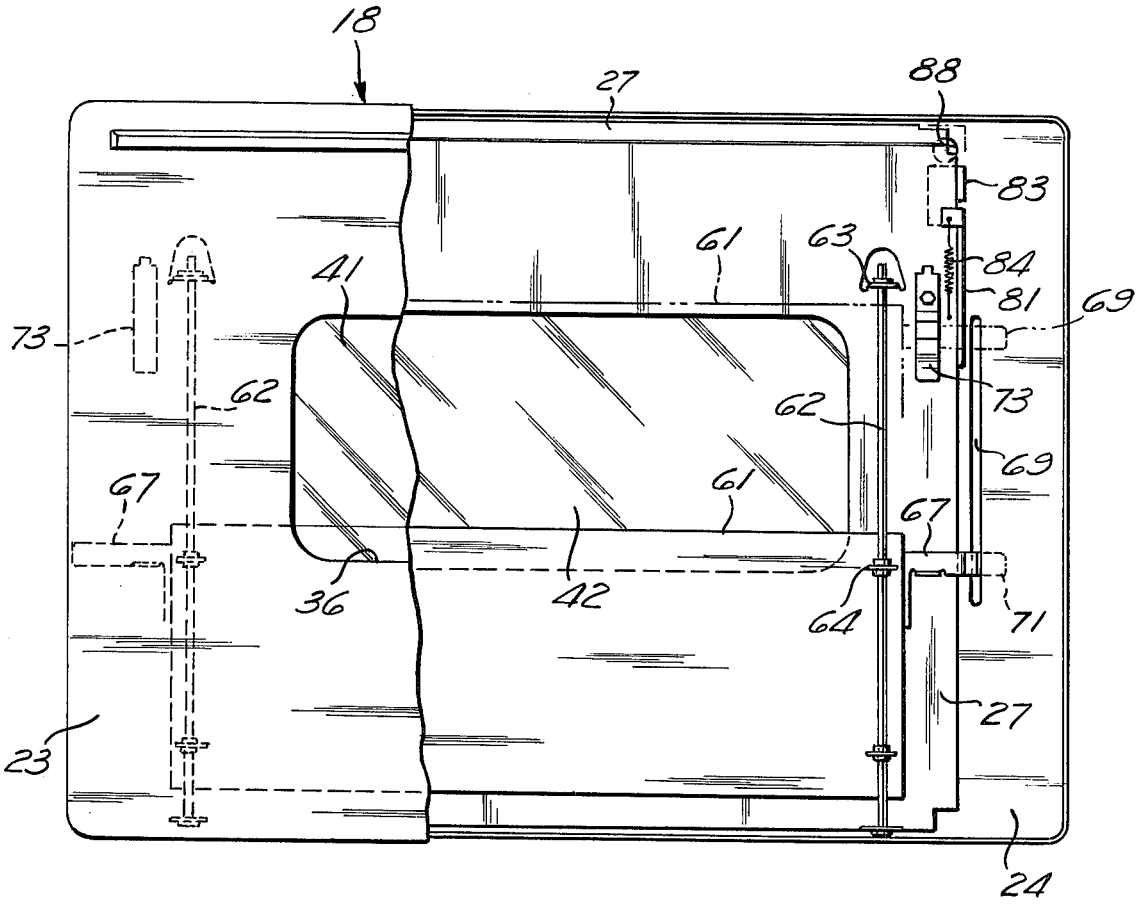
FIG. 2 is a front elevational view of the oven door having portions thereof cut away to reveal constructional details.

As will be understood by reference to FIGS. 1 and 2, the hand grip portions 71 are accessible when the door assembly 18 is in its open position, so that by manually engaging the hand grips, the shutter may be moved from its open position, illustrated in solid line in FIGS. 2 and 3, to its closed position, illustrated in phantom in FIG. 3 and in solid line in FIG. 4 between the glass sheets 41 and 42. At this closed position, with the door assembly 18 in its closed or upright position, the shutter 61 shields the oven cavity from view through the oven window and reflects heat radiation originating in the oven cavity 12.

A pair of spring clips 73 are secured by screws 74 to the air wash sheet 27 in the path of the handle bracket 67. In their illustrated, installed condition, the clips 73 are pretensioned such that their free ends, designated 76, are resiliently held against the air wash sheet 27. An arched portion 77 of each clip 73 forms a detent to hold angularly depending tabs 78 of the handles 67 and thereby maintain the shutter 61 in its upper or closed position of FIG. 4.

In accordance with the invention, there is provided shutter position indicator means and sensor means responsive to the position indicator means adapted to interlock the closed position of the door assembly 18 and the closed position of the shutter 61 with the control of the oven heating means. In the illustrated embodiment, the indicator means is provided in the form of a slide element 81 slidable on the door in response to shutter movement through direct engagement with the right-hand handle bracket 67. In this regard, the handle bracket 67 functions as an extension of the shutter 61 and it will be appreciated that other arrangements may be resorted to wherein the indicator slide element 81 or its equivalent is engaged directly by the shutter.

The indicator slide element 81 comprises an elongated body formed of sheet stock and having integrally formed tabs 82 and 83 extending at right angles to the main body. A larger one 83 of the tabs is disposed immediately adjacent the outward side (away from the oven) of the inner liner 24. A tension spring 84 is anchored in a hole formed in the air wash sheet 27 and hooked at its other end in the slide tab 82 so that it resiliently biases the slide downwardly from the position indicated in FIG. 4 to that illustrated in FIG. 2. The strength of the retaining clips 73 is sufficient to resist the force of the tension spring 84 and maintain the slide in the upper position of FIG. 4. The handle bracket 67 engages an end face 86 of the slide 81 during the final closing movement of the shutter. The slide element 81 is secured against and guided for sliding movement on the air wash flange 31 by a pair of shoulder screws 80. As shown, the shoulder screws 80 are vertically spaced and threaded into the flange 31.

A hole 88 in the liner 24 adjacent its upper edge, i.e., remote from the hinges 19, is dimensioned to admit a sensing probe 89 into the door assembly 18. As shown in FIG. 4, the lower edge 86 of the slide 81 lies in the path of the handle bracket 67 such that when the shutter 61 is raised to its fully closed position, the handle, during the end period of its movement, moves the slide tab 83 to the upper position shown in FIG. 4. In this position, the indicator tab 83 lies immediately behind the aperture or hole 88 and indicates that the shutter 61 is closed.

The illustrated sensing probe 89 is mounted on the outer face 51 of the oven frame and is resiliently outwardly biased by a suitable spring (not shown) in the direction towards the door assembly. Ideally, the probe or pin 89 controls a limit switch (not shown) either immediately behind it or at the rear of the oven frame and interconnected to it by an elongated rod or the like.

During normal cooking operations, the shutter 61 may be stationed in the lower retracted or open position of FIGS. 2 and 3 to permit visual inspection of the oven cavity through the oven door window. During pyrolytic cleaning of the oven, relatively high temperatures are developed within the oven cavity 12 and it is desirable to shield against escape of thermal radiation from the cavity through the window area by positioning the shutter 61 across the window area. For purposes of safety, it is also desirable that the oven door be prevented from opening by a suitable latching apparatus engageable with a keeper pin 90 (FIG. 3) or the like, such as the apparatus shown and described in detail in U.S. Pat. No. Re. 27,545 awarded to W. R. Guy, and assigned to the assignee of the present invention. The disclosure of the aforementioned U.S. Pat. No. Re. 27,545 is incorporated herein by reference. As disclosed in this patent, a door switch, designated 105 therein, senses the fully closed position of the door to enable an electric circuit to be energized to initiate operation of a latching device, designated 50 therein, to lock the door in a closed position while the oven cavity is at the high temperatures generated during pyrolytic cleaning. The sensing probe 89 disclosed hereinabove may be used to operate the switch 105 and associated circuit disclosed in the aforementioned W. R. Guy patent. A separate manually operated switch may be provided to control the oven illuminating lamp 109 disclosed in the patent so that the light need not be energized when the shutter 61 is open. In this latter case, a single pole, single throw switch can be substituted as an equivalent for the single pole, double throw switch of the patent.

It will be understood from the foregoing description that the sensing element 89 and any switch responding to it will have two conditions, namely, a retracted position illustrated in FIG. 4, wherein the sensing element protrudes only slightly from the oven face 51 by virtue of contact with the indicating tab 83, and a second position wherein it extends somewhat farther from the oven face by virtue of a biasing force tending to maintain it in this relatively extended position. The extended or second state of the sensor element 89 can occur only when the door assembly 18 is open or the shutter 61 is not fully closed, or when both of these conditions exist. Thus, the sensor element 89 when held in the retracted state in FIG. 4 simultaneously determines that both the door and shutter are closed and that it is appropriate to initiate door latching and heating activity for pyrolytic cleaning. Stated in other words, the sensor element 89 is adapted to interlock the closed position of the door and closed position of the shutter to condition appropriate control means, such as an electrical switch to cause the door to be automatically latched and the oven heating elements to be energized to begin oven cleaning operations. It will also be understood that suitable door latching mechanism, manual or otherwise, besides that illustrated in the aforementioned U.S. Pat. No. Re. 27,545, may be employed with the sensor element 89 of the invention.

With particular reference to FIG. 3, during oven operation, and particularly during pyrolytic cleaning, a continual flow of air by natural convection will occur in the door space 55, with air entering the lower apertures 53 and exiting the upper apertures 54. This continuous wash of air reduces conduction of heat to the outer door panel 23 and its glass panel 41, and at the same time tends to cool these elements. Moreover, the generally straight, vertical path for air flow in the space 55 afforded by the generally planar air wash sheet 27 encourages air flow over both sides of the shutter 61 particularly in its closed or upward position. That is, the disclosed arrangement permits convection heat transfer from the shutter 61 by flow between the shutter and both adjacent glass sheets 41 and 42. The resultant cooling of the shutter reduces its radiation to the outer door panel 23 and the outer glass 41, thereby reducing the maximum temperature of their external surfaces to avoid danger to the user. The location of the shutter position indicator 81 laterally away from the zones of the shutter 61 and the air wash panel 27 ensures that this element does not impede air flow through the major width of the air wash space 55 and ensures that it is in a relatively cool area such that the sensing element or probe 89 in contact with it and any switches associated with it are protected from severe temperature exposure.

While the invention has been described in connection with specific embodiments thereof, it is to be clearly understood that this is done only by way of example, and not as a limitation to the scope of the invention as set forth in the objects thereof and in the appended claims.

What is claimed is:

1. An oven assembly comprising a frame enclosing an oven cavity, an opening in the frame for access to the cavity, a door hinged at one side thereof on the frame for closing the opening, a window in the door for viewing the contents of the cavity during cooking operation, the window being closed by glass sheet means, manually operable shutter means selectively movable within the door, means guiding said shutter means for translation when the door is open between an open position allowing visual inspection of the interior of the cavity through the window when the door is closed, and a closed position preventing direct radiation through the window from the cavity when the door is closed, indicator means within the door remote from the hinge side thereof means for guiding said indicator means for translation in a direction parallel to the movement of said shutter means responsive to the position of the shutter, said indicator being in a first position when the shutter is in its open position and in a second position when the shutter is in its closed position, sensor means arranged on the frame to protrude into the door to sense the presence of the indicator means in the second position when the door is closed, the sensor means being arranged to sense an open condition of the door and/or the first position of the indicator means in a manner detectably different from the manner in which both the closed door and the second position of the indicator are simultaneously sensed whereby the sensor means is adapted to be used to control operation of the oven heater by permitting operation thereof only when the door and shutter are closed and by preventing operation of the oven heater for pyrolytic cleaning when the door is open and/or the shutter is open.

2. An assembly as set forth in claim 1, wherein said indicator means is disposed laterally of the shutter within the door.

* * * * *